United States Patent [19]

Steuer et al.

[11] Patent Number: 5,031,856

[45] Date of Patent: Jul. 16, 1991

[54] AIRBORNE SUBMUNITION MEMBER

[75] Inventors: Raimar Steuer, Leinburg; Werner Kraus, Neumarkt, both of Fed. Rep. of Germany

[73] Assignee: Diehl GmbH & Co., Nuremberg, Fed. Rep. of Germany

[21] Appl. No.: 510,747

[22] Filed: Apr. 18, 1990

[30] Foreign Application Priority Data

May 12, 1989 [DE] Fed. Rep. of Germany ..... 3915585

[51] Int. Cl.[5] ..... F42B 10/14

[52] U.S. Cl. ..... 244/3.27; 244/3.28

[58] Field of Search ..... 244/3.26, 3.27, 3.28, 244/3.29, 47, 49; 102/393, 489

[56] References Cited

U.S. PATENT DOCUMENTS

| | | | |
|---|---|---|---|
| 3,853,288 | 12/1974 | Bode | 244/3.29 |
| 4,752,052 | 6/1988 | Galvin | 244/3.29 |
| 4,844,381 | 7/1989 | Brieseck et al. | 244/3.29 |
| 4,964,593 | 10/1990 | Kranz | 244/3.24 |

FOREIGN PATENT DOCUMENTS

| | | | |
|---|---|---|---|
| 3730019 | 12/1988 | Fed. Rep. of Germany | 102/489 |
| 1188651 | 4/1970 | United Kingdom | 244/3.27 |
| 2121147 | 12/1983 | United Kingdom | 244/3.29 |

*Primary Examiner*—Michael J. Carone

*Attorney, Agent, or Firm*—Scully, Scott, Murphy & Presser

[57] ABSTRACT

An airborne submunition member having mountings or holders for glide wings arranged offset relative to each other exteriorly on the trunk or body of the airborne member, from which mountings glide wings are outwardly extendable, which are retracted into the glide wing mountings in the transport position of the member. At least one of the glide wing mountings or holders is supported on the trunk of the airborne submunition member so as to be pivotable or revolvable about the longitudinal axis thereof, and in the transport position is pivoted or rotated towards one of the other glide wing mountings.

6 Claims, 1 Drawing Sheet

AIRBORNE SUBMUNITION MEMBER

BACKGROUND OF THE INVENTION

1. Field of the Invention

The present invention relates to an airborne submunition member having mountings or holders for glide wings arranged offset relative to each other exteriorly on the trunk or body of the airborne member, from which mountings glide wings are outwardly extendible, which are retracted into the glide wing mountings in the transport position of the member, and wherein at least one of the glide wing mountings or holders is supported on the trunk of the airborne submunition member so as to be pivotable or revolvable about the longitudinal axis thereof, and in the transport position is pivoted or rotated towards one of the other glide wing mountings.

An airborne submunition member of that type possesses the advantage that, in the transport position, the mountings for the glide wings require only a small amount of space within a carrier, and are arranged in a spatial region which is already room or space available within the carrier.

2. Discussion of the Prior Art

In order to be able to bring the pivotable glide wing mountings from the transport position into the position of flight, torsion springs are provided in conformance with the disclosure of U.S. Pat. No. 4,844,381, which is commonly assigned to the assignee of the present application. These springs necessitate the formation of a comparatively large cutout in the body or trunk of the airborne member. Consequently, in view of such a cutout, the mechanical strength of the trunk is significantly reduced.

SUMMARY OF THE INVENTION

Accordingly, an object of the present invention is the provision of an airborne submunition member of the type referred to hereinabove in which the movable glide wing mounting or mountings can be pivoted or revolved into the position of flight without necessitating the presence of a cutout for this purpose, the size of which would conceivably significantly weaken the trunk or body of the airborne member.

Inventively, the above-mentioned object is attained for an airborne submunition member of the type described hereinabove, in that a motor is arranged in the trunk, through the intermediary of which motor a drive wheel or gear is rotatable about an axis of rotation which extends in parallel with the longitudinal axis of the trunk of the airborne member, and wherein the drive wheel or gear projects outwardly through a cutout formed in the trunk and engages a segmental component which carries the movable glide wing mounting and which is supported on the exterior of the trunk so as to be pivotable or revolvable about the longitudinal axis thereof.

The cutout which is formed in the trunk or body of the airborne member is relatively small in size. At its largest, the cutout is smaller than the diameter of the drive wheel. The trunk of the airborne member is thus hardly to any extent reduced in strength by the presence of the cutout. Inasmuch as the cutout is essentially covered over by the drive wheel, there is eliminated the need for the provision of any complicated sealing media.

It is also expedient that through the utilization of the motor, the pivoting or revolving of the glide wing mounting or mountings can be more easily controlled than with the employment of torsion springs.

Inasmuch as the glide wing mounting or mountings must be brought through the operation of the motor only one single time from the transport position into the position of flight, it is necessary to essentially impart only one direction of rotation to the motor. Pursuant to a preferred embodiment of the invention, at a reverse direction of rotation of the motor, the latter leads to the outward extension of the glide wings.

BRIEF DESCRIPTION OF THE DRAWINGS

Further advantageous modifications and features of the invention may now be more readily ascertained from the following detailed description of an exemplary embodiment thereof, taken in conjunction with the accompanying drawings; in which.

DETAILED DESCRIPTION

Figure 1:
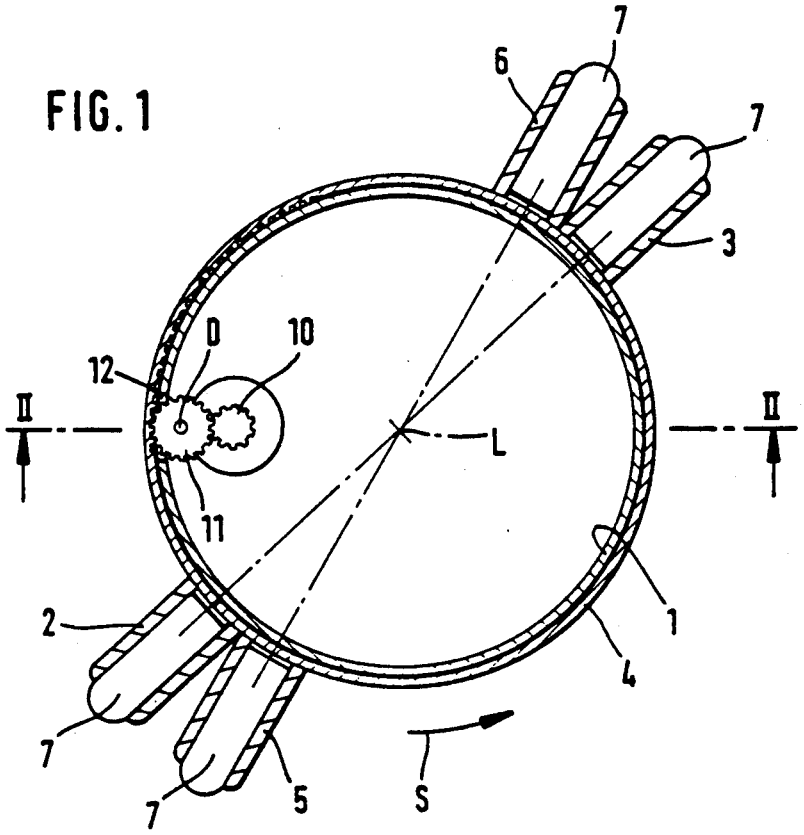
FIG. 1 illustrates, generally diagrammatically, a transverse cross-sectional view through an airborne submunition member which is constructed pursuant to the invention.

An airborne submunition member possesses a trunk or body 1 on the outside of which there are fixedly mounted two glide wing holders or mountings 2, 3.

The outer circumference of the trunk 1 is encompassed by a ring member 4 on the latter of which there are fixedly mounted two further glide wing holders or mountings 5, 6. The ring member 4 is pivotable or revolvable about the longitudinal axis L of the trunk 1. The ring member forms a segmental component which encompasses the trunk 1 through an angle of 360°. Instead thereof, there can also be provided a segmental component which encircles the trunk 1 by an angle of less than 360°.

Respectively, supported on each glide wing mounting 2, 3, 5 and 6 is a glide wing 7 so as to be outwardly extendible therefrom. For effectuating the outward extension of the respective glide wing 7, a suitable extending device (not shown) is arranged on each glide wing holder or mounting 2, 3, 5 and 6.

Within the trunk or body 1 of the airborne member there is arranged an electric motor 8 possessing a drive 9, such as a gear drive. A drive wheel or gear 11 interdigitates with a pinion 10 of the gear drive 9. The axis of rotation D of the drive wheel or gear 11 extends in parallel relationship with the longitudinal axis L of the body or trunk 1 of the airborne member. The drive wheel 11 projects outwardly through a cutout 12 which is formed in the trunk 1, and engages an internal gearing 13 which is formed on the ring member 4. This gearing 13 does not necessarily have to extend over the entire circumference of the ring member 4. It is adequate that this gearing be provided only over an angular sector through which the ring member 4 is to be pivoted or revolved. In the event that the drive wheel 11 is constructed as a friction wheel, then the need for the internal gearing is obviated.

The diameter of the drive wheel 11 is substantially smaller than the diameter of the trunk 1 of the airborne member. The axis of rotation D of the drive wheel 11 is located within the trunk in close proximity to the inner circumference thereof.

The mode of functioning for the above-described arrangement is generally as follows:

In FIG. 1 of the drawing there is represented the transport position for the submunition. The glide wing mounting 5 is located in close proximity to the glide wing mounting 2. The glide wing mounting 6 is located in close proximity to the glide wing mounting 3. The glide wings 7 are retracted into the glide wing mountings 2, 3, 5 and 6. As a result thereof, the submunition requires only a small amount of space within a suitable carrier (not shown).

After the expulsion of the submunition from the carrier, the heretofore arrested ring member 4 is released. The motor 8 then begins to operate. In consequence thereof, the drive wheel 11 pivots or revolves the ring member 4 in the direction of the arrow S about the longitudinal axis L through an angle of displacement of about 70° until it contacts a stop. The glide wing mountings 5, 6 are accordingly positioned such that they are offset by an angle of 90° relative to the glide wing mountings 2, 3 about the circumference of the trunk 1. Thereafter, the glide wings 7 are extended outwardly.

Figure 2:
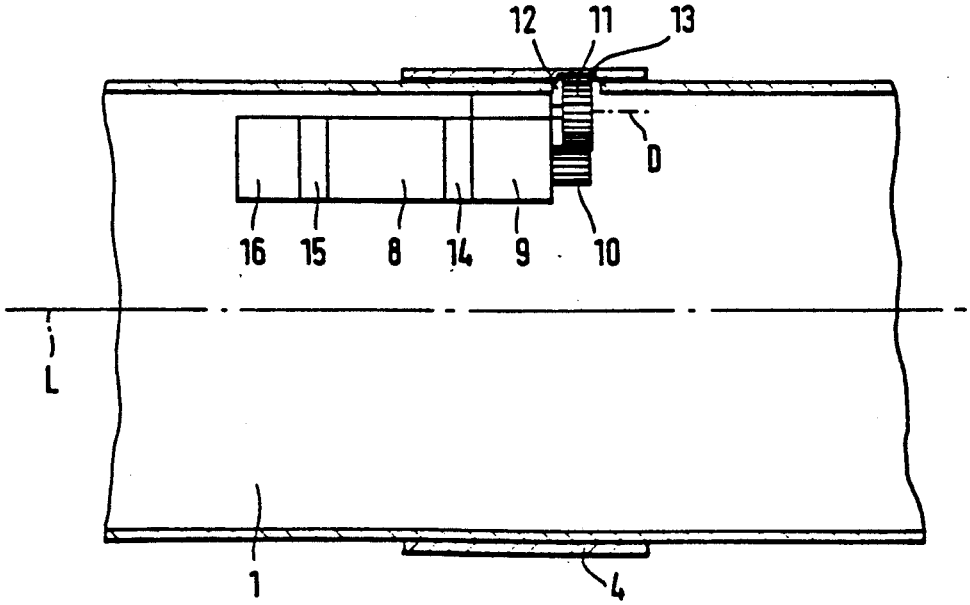
FIG. 2 illustrates a sectional view taken along line II—II in FIG. 1.

In accordance with FIG. 2, a clutch or coupling 14 is arranged intermediate the gear drive 9 and the electric motor 8. This clutch couples the gear drive 9 with the electric motor 8 only in one direction for the motor 8, and namely, in that direction of rotation in which the glide wing mountings 5, 6 are pivoted or revolved in the direction of the arrow S from their transport position into the position of flight. A drive 16 is coupled with the motor 8 by means of a further coupling or clutch 15. The clutch 15 couples the drive 16 with the motor 8 only in a direction of rotation which is in reverse relative to the previously mentioned direction of rotation. The drive 16 is connected with the extending devices for the outward actuation of the glide wings 7, and is designed in such a manner that, through the functioning thereof, the extending devices are released for effectuating the outward extension of the glide wings 7.

This arrangement operates in the following manner:

When the glide wing holders or mountings 5, 6 have been displaced into their positions of flight, the direction of rotation of the motor 8 is then reversed. Due to the coupling or clutch 14 the glide wing mountings 5, 6 remain in their positions of flight. The drive 16, which is now set into motion by the motor 8, unlatches the extending devices for the glide wings 7, so that the latter are outwardly extended into their positions of flight.

What is claimed is:

1. Airborne submunition member including a trunk, mountings for glide wings being arranged on the exterior of said trunk offset relative to each other; glide wings fastened to each of said glide wing mountings so as to be outwardly extendable therefrom, and in the transport position of said airborne submunition member said glide wings being retracted into said glide wing mounting, at least one of said glide wing mountings being supported on the trunk of said airborne submunition member so as to be revolvable about the longitudinal axis of said airborne submunition member, and in the transport position being revolved towards one of the other of said glide wing mountings; a motor arranged in said trunk; a drive wheel driven by said motor to rotate about an axis of rotation extending in parallel with the longitudinal axis of said trunk, said drive wheel projecting through a cutout formed in said trunk and operatively engaging a segmental component supporting the at least one revolvable glide wing mounting; said segmental component being supported in the exterior of said trunk so as to be rotatable about the longitudinal axis of said trunk.

2. Airborne submunition member as claimed in claim 1, wherein said drive wheel is a gear which engages an internal gearing on said segmental component.

3. Airborne submunition member as claimed in claim 1, wherein the size of the cutout is smaller than the diameter of the drive wheel.

4. Airborne submunition member as claimed in claim 1, wherein the diameter of the drive wheel is smaller than the diameter of the trunk.

5. Airborne submunition member as claimed in claim 1, wherein the segmental component comprises a ring member encompassing said trunk.

6. Airborne submunition member as claimed in claim 1, wherein the motor comprises an electric motor.

* * * * *